US007495161B1

(12) United States Patent
Richards

(10) Patent No.: US 7,495,161 B1
(45) Date of Patent: Feb. 24, 2009

(54) DRUMHEAD TENSIONING SYSTEM, APPARATUS, AND METHOD

(76) Inventor: Daniel W. Richards, 3107 Midway Dr., Island Lake, IL (US) 60042

( * ) Notice: Subject to any disclaimer, the term of this patent is extended or adjusted under 35 U.S.C. 154(b) by 0 days.

(21) Appl. No.: 11/974,862

(22) Filed: Oct. 16, 2007

(51) Int. Cl.
*G10D 13/04* (2006.01)

(52) U.S. Cl. ..... 84/411 R

(58) Field of Classification Search ..... 84/415, 84/411 R

See application file for complete search history.

(56) References Cited

U.S. PATENT DOCUMENTS

| | | | | |
|---|---|---|---|---|
| 3,856,267 | A | 12/1974 | Flannelly | |
| 4,228,721 | A | 10/1980 | Hancox | |
| 4,609,894 | A | 9/1986 | Oguchi | |
| 4,741,242 | A | 5/1988 | Aronstein | |
| 4,870,883 | A | 10/1989 | Gauger | |
| 5,394,775 | A | 3/1995 | Fagerstrom | |
| 5,487,320 | A | 1/1996 | De Mowbray | |
| 5,689,076 | A | 11/1997 | Usuda | |
| 5,739,448 | A | 4/1998 | Toscano | |
| 5,770,810 | A | 6/1998 | Lombardi | |
| 5,977,463 | A | 11/1999 | Bartlett | |
| 6,242,680 | B1 | 6/2001 | Benton, Jr. | |
| 6,747,199 | B2 | 6/2004 | Shah | |
| 6,812,392 | B2 | 11/2004 | Brando | |
| 7,045,696 | B2 | 5/2006 | Henry | |
| 7,148,413 | B2 | 12/2006 | May | |
| 7,223,910 | B2 * | 5/2007 | Shimada | 84/415 |
| 7,365,256 | B2 * | 4/2008 | Takegawa | 84/415 |

* cited by examiner

*Primary Examiner*—Kimberly R Lockett
(74) *Attorney, Agent, or Firm*—Meroni + Meroni, P.C.; Charles F. Meroni, Jr.; Christopher J. Scott

(57) ABSTRACT

A drumhead tensioning and tuning apparatus comprises opposed carriage-like tensioning-tuning assemblies each of which comprises a drum gauge and a torque-supplying implement for selectively rotating head tensioning rods of a drum assembly. The tensioning-tuning assemblies are track mounted such that the opposed assemblies may be linearly displaced relative to one another. The apparatus may thus be positioned diametrically across drums of varying dimensions and the tensioning-tuning assemblies may be outfitted adjacent or at opposed drumhead portions for simultaneously tensioning and tuning the opposed drumhead portions. The apparatus may then be removed from the first set of opposed drumhead portions and outfitted upon a successive pair of drumhead portions according to standard drum tuning sequencing schemes. The ability to simultaneously tension and tune sequential and successive pairs of opposed drumhead portions enables expedited drumhead tuning. Certain drumhead tuning methodology is further supported by the apparatus.

20 Claims, 5 Drawing Sheets

DRUMHEAD TENSIONING SYSTEM, APPARATUS, AND METHOD

BACKGROUND OF THE INVENTION

1. Field of the Invention

The disclosed invention generally relates to an apparatus for tuning drums. More particularly, the disclosed invention relates to an apparatus for expediting and enhancing drumhead tuning incorporating track-mounted dual drum gauges and rod-tensioning implements for simultaneously tensioning diametrically opposed tensioning rods of a drum assembly.

2. Brief Description of the Prior Art

Drums are ancient devices for producing sound. Technically classified as "membranophones," drums typically comprise at least one membrane or drumhead that is stretched over a shell and struck with some implement to produce the sound. Most drums are often referred to as "untuned instruments" because they have no definite pitch, although there are some exceptions such as timpani drums. Drums however may be "tuned" to increase or decrease the pitch of the drum, typically by adjusting the tension of the stretched drumhead. Some of the more pertinent prior art disclosures relating to drums and means for tensioning drumheads are briefly described hereinafter.

U.S. Pat. No. 5,487,320 ('320 patent), which issued to De Mowbray, discloses a Drum and Drum Gauge. The '320 patent teaches a drum and drum gauge wherein a head is supported on a cylindrical shell which is open at its bottom and provided with tensioning bolts for tensioning the head to tune the drum. The drum shell is detachably connected to a stand. The stand can be easily folded to a closed position for ease of transport. The tuning part of the drum comprises a plurality of arms extending substantially horizontally and radially from a tension bolt at one end, through a bushing in the shell, to a central operating rod at the other. Upward movement of the central rod moves the tension bolts downwards, with a lever action, increasing the tension of the drum head. The lower end of the central rod is attached to a foot lever pivotable about a horizontal access and carrying a pedal for applying a brake. A gauge for indicating the drum's pitch has a fixed scale and a movable indicator coupled to the foot lever by a sheathed cable. Alternatively, the gauge has a fixed indicator and a scale pivotally fixed to the drum shell coupled to the foot lever by a rigid rod.

U.S. Pat. No. 5,739,448 ('448 patent), which issued to Toscano, discloses a Drum Tension System. The '448 patent essentially teaches an improved tuning system for a musical percussion drum. The tuning system utilizes an inverted J-shaped counterhoop that is threadably engaged with an externally threaded, outwardly facing tuning rim surface on a tuning collar that is secured to the drum shell. An interior portion of the counterhoop projects downwardly into a channel defined between the externally threaded tuning rim of the tuning collar and a bearing ring on the tuning collar located inwardly and separated from the tuning rim by the channel. The pressure ring bears downwardly on a hoop that is secured to the periphery of the drum skin. Rotation of the counterhoop in one direction screws the counterhoop further onto the drum shell, thereby tightening the drum skin. Counterrotation of the counterhoop in the opposite direction loosens the drum skin. Rotation is achieved by engagement of a pair of driving gears supported by a gear mount attached to the outer surface of the tuning collar. The driving gear teeth engage ring gear teeth that project radially outwardly from the counterhoop. Rotation of one of the driving gears in either of two alternative directions provides gross incremental adjustment in tension on the drum skin. The second driving gear provides a finer adjustment in tension. A pawl mechanism is selectively engageable with the driving gears to prevent the counterhoop from unscrewing from the tuning rim.

U.S. Pat. No. 5,977,463 ('463 patent), which issued to Barlett, discloses a Tuning Mechanism for a Drum. The '463 patent teaches a percussion-type drum assembly comprising a generally cylindrical shell which is open at both ends and has a sidewall that defines an inner diameter and an outer diameter. A generally circular centering ring is also provided. The centering ring has a diameter that is larger than the outer diameter of the shell and is adapted to be disposed around the exterior of the sidewall of the shell without making contact with the shell. The drum assembly also includes a pair of membrane mounting and tuning assemblies, one for each end of the shell. Each of these assemblies includes a membrane that is adapted to cover an open end of the shell in a desired state of tension, and which has a diameter that is at least as large as the outer diameter of the shell. Each membrane mounting and tuning assembly also includes a generally circular rim having a diameter that is at least as large as the outer diameter of the shell. The rim is adapted to fit over an end of the shell with the membrane disposed between the shell and the rim so that the rim does not contact the sidewall of the shell. Each assembly also includes a plurality of tuning lugs, each of which is adapted for attachment between the rim and the centering ring without making contact with the shell and for adjustably changing the distance between the rim and the ring so that the desired state of tension in the membrane may be maintained. A method for adjusting the tension in the membranes of the drum is also disclosed.

U.S. Pat. No. 6,242,680 ('680 patent), which issued to Benton, Jr., discloses a Drum Tensioning Device. The '680 patent teaches a drum tuning device for distributing the drawing force exerted on the drumhead by the tensioning lugs over an increased circumferential segment of the drum hoop. The tuning device includes a generally planar, relatively thin tuning plate having a circumferential dimension, a radial dimension and a thickness dimension. The circumferential dimension is substantially greater than the radial dimension and the thickness dimension. The tuning plate includes an arcuate inner surface conforming to the radial contour of the drum hoop and an outer surface substantially parallel to the inner surface. The tuning plate has an opening therethrough positioned medially between the inner surface and the outer surface. The tuning plate is positioned between the head portion of the one of the tensioning lugs and the drum hoop. The tensioning lug is inserted through the opening of the tuning plate and engages the internally threaded floating fastener of a corresponding lug casing to exert the drawing force on the drum hoop and the drumhead. In an alternative embodiment, the drum tuning device includes a generally planar, relative thin tuning plate and further includes a relatively thin, wedge-shaped spacer having an opening therethrough. The spacer is positioned between the tuning plate and the drum hoop to provide a flat support surface for receiving the head of the tensioning lug. Preferably, the drum tuning device includes a plurality of tuning plates, or a plurality of tuning plates and spacers, corresponding to the plurality of tensioning lugs and lug casings provided on the drum.

U.S. Pat. No. 7,045,696 ('696 patent), which issued to Henry, discloses a Single Adjustment Balancing and Tuning of Acoustic Drums. The '696 patent teaches an apparatus and method for enabling simultaneous balancing and tuning of an acoustic drum with a single adjustment. A band, such as a cable, extends about adjustment ties, which band holds the drum skin or head to the housing or hoop of the drum so that, when tightened, the head will be placed under tension. The tension applied to the skin or head is thus evenly distributed. In this way, one touch tuning is achieved with simultaneous balancing since there will be a constant tension applied to each of the ties holding the drum skin on the body of the drum.

It may be seen from an inspection of the foregoing disclosures that the prior art is silent on a drumhead tensioning apparatus comprising track-mounted dual drum gauges and dual rod-tensioning implements for simultaneously tensioning and tuning diametrically opposed drumhead portions. The prior art thus perceives a need for such an apparatus, which apparatus may well function to expedite and enhance drumhead tuning.

SUMMARY OF THE INVENTION

Accordingly, it is an object of the present invention to provide a drumhead tensioning and tuning system, apparatus, and method whereby users of the apparatus in combination with a drum assembly may simultaneously tension and tune sequentially paired tensioning rods. The simultaneous or nearly simultaneous tensioning and tuning of diametrically opposed drumhead portions expedites and enhances the tuning process. To achieve these and other readily apparent objectives, the drumhead tensioning apparatus of the present disclosure comprises opposed carriage-like tensioning assemblies received or mounted on a track, which track is outfitted upon a drum assembly as described in more detail hereinafter.

The drum assembly usable in combination with the drumhead tensioning apparatus essentially comprises a drumhead, a shell, a bezel-like counterhoop, and a plurality of tensioning rod assemblies. Each tensioning rod assembly comprises a screw or threaded rod member and a rod-receiving lug. The lugs are attached to the shell, and the drumhead is stretched over the shell and there held by the counterhoop. The screws or threaded rod members screw-connect the lugs to the counterhoop for enabling drumhead tensioning by rotation of the threaded rod member thereby displacing the counterhoop relative to the lugs and imparting varying degrees of tension to the drumhead radially and inwardly adjacent the rotated rod.

The drumhead tensioning apparatus comprises opposed carriage-like tensioning assemblies, each of which comprises certain pressure-measuring means for measuring tympanic pressure and certain torque-supplying means for supplying rod-rotating torque. The pressure-measuring means are exemplified by drum gauges or drum dials, and the torque-supplying means are exemplified by drum keys or similar other manual devices for rotating tensioning rods. The torque-supplying means are cooperable with linearly opposed tensioning rods on the described drum assembly for enabling the user to selectively and simultaneously tension opposed drumhead portions, and the pressure-measuring means enable the user to simultaneously monitor drumhead tension at the opposed drumhead portions. The apparatus thus enables the user to tension and tune sequentially paired drumhead portions at substantially the same time, which process operates to expedite and enhance drumhead tuning.

As the apparatus is designed to expedite drumhead tuning, the apparatus necessarily involves procedural aspects. In this regard, it is contemplated that the present invention further sets forth or supports certain drumhead tuning methodology comprising the steps of engaging certain tension monitoring means with opposed drumhead portions; monitoring drumhead tension at the opposed drumhead portions; selectively tensioning the opposed drumhead portions (by way of head-tensioning rods and applying torque to the same for adjusting the drumhead tension); and disengaging the tension monitoring means from the opposed drumhead portions when the monitored drumhead tension at the opposed drumhead portions is equivalent.

The drumhead tuning methodology may additionally comprise the steps of synchronizing the tension monitoring means before engaging the opposed drumhead portions; track-guiding or rail-guiding the tension monitoring means to the opposed drumhead portions before engaging the opposed drumhead portions; minimizing friction and associated thermal effects while track or rail-guiding the tension monitoring means to the opposed drumhead portions; and spring-resisting applied torque during the step of tensioning the opposed drumhead portions, which spring resistance may be coaxially aligned with the applied torque for enhancing drumhead tuning. Naturally, the steps may be repeated with successive pairs of opposed drumhead portions until the monitored drumhead tension at all opposed drumhead portions is substantially equivalent.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of patent drawings:

FIG. 6(*a*) is a diagrammatic top plan type depiction of a ten (10) lug drum with preferred tuning sequence set forth adjacent the circumference.

FIG. 6(*b*) is a diagrammatic top plan type depiction of a six (6) lug drum with preferred tuning sequence set forth adjacent the circumference.

DETAILED DESCRIPTION OF THE PREFERRED EMBODIMENT

Figure 1:
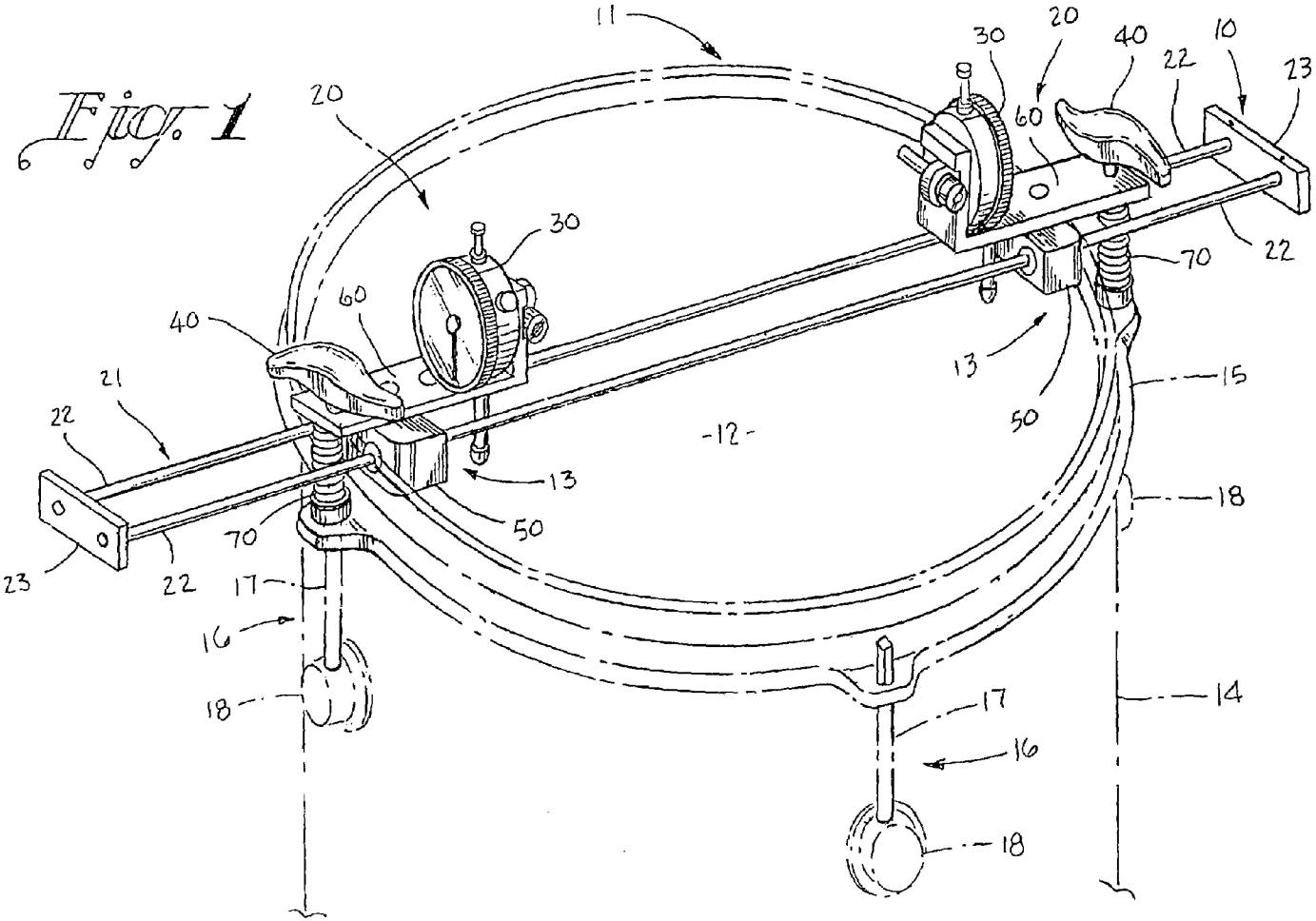
FIG. 1 is a top perspective view of the drumhead tensioning apparatus of the present invention as outfitted upon a fragmentary generic drum assembly, which drum assembly is depicted in phantom.

Referring now to the drawings with more specificity, the preferred embodiment of the present invention concerns a drumhead tuning apparatus 10 as generally illustrated and referenced in FIGS. 1 and 3-5. The drumhead tuning apparatus 10 is designed for use in combination with a drum assembly 11 as further illustrated and referenced in FIGS. 1 and 3-6(*b*). Viewed as a combination, the drum assembly 11 and the drumhead tuning apparatus 10 may be viewed as a drumhead tuning system for expediting drumhead tuning independently from aurally monitoring pitch. In other words, the drumhead 12 of the drum assembly 11 may be tuned via certain visual indicators of the drumhead tuning apparatus 10, which apparatus enables simultaneous (or nearly simultaneous) drumhead tensioning and tension monitoring at linearly opposed drumhead portions 13 as generally depicted and referenced in FIGS. 1 and 3-6(*b*).

The drum assembly 11 usable in combination with the drumhead tuning apparatus 10 preferably and essentially comprises a drumhead 12 as illustrated and referenced in FIGS. 1 and 3-6(*b*); a shell 14 as illustrated and referenced in FIGS. 1 and 3-5; a (bezel-like) counter hoop 15 as illustrated and referenced in FIG. 1; and a plurality of tensioning rod or tuning screw assemblies 16 as illustrated and referenced in FIGS. 1 and 3-5. It may be understood from an inspection of the noted figures that each tensioning rod assembly 16 comprises a screw or threaded rod member 17 and a rod-receiving lug 18. It is noted that some drum assemblies may comprise both a top drumhead and a bottom drumhead. Often the top drumhead is referred to as the "batter" drumhead whereas the bottom drumhead is often referred to as the "resonant" drumhead. While reference is made to a single drumhead throughout this specification, it is contemplated that the principles may be easily applied to drums having both a batter and a resonant drumhead.

The lugs 18 are attached to the shell 14, and the drumhead 12 is stretched over the shell 14 and there held by the counter hoop 15. The screws or threaded tensioning rods 17 screw-connect the lugs 18 to the counter hoop 15 for enabling drumhead tensioning by screw-displacing the counter hoop 15 relative to the lugs 18. In other words, the rods 17 are threadably received by the lugs 18 and attached counter hoop 15 such that when a torque is applied to a give rod 17, the rod 17 rotates and displaces the counter hoop 15 relative to the corresponding lug 18 thereby adjusting the tension of the drumhead 12 at the drumhead portion 13 adjacent the given tensioning rod assembly 16.

The drumhead tuning apparatus 10 preferably comprises opposed carriage-like tensioning/tuning assemblies 20 as illustrated and referenced in FIGS. 1-5; and a track or track assembly 21 as illustrated and referenced in FIGS. 1 and 3-5. Each carriage-like tuning assembly preferably comprises certain pressure-measuring means for measuring tympanic pressure and certain torque-supplying means for supplying screw torque. It is contemplated that the pressure-measuring means may be preferably defined by a drum or head gauge as may be exemplified by the DRUMDIAL brand drum gauge manufactured by DRUMDIAL, Inc., 1830 East Broadway, #124-197, Tucson, Ariz., 85719; 800.860.0321 (telephone); 1.520.578.8975 (facsimile).

Figure 8:
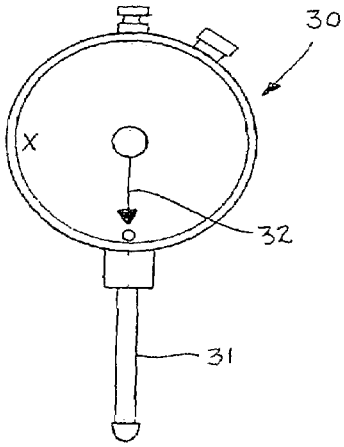
FIG. 8 is a front plan view of a drum gauge showing a reading of zero force/pressure with zero force/pressure being applied to the gauge.
Figure 9:
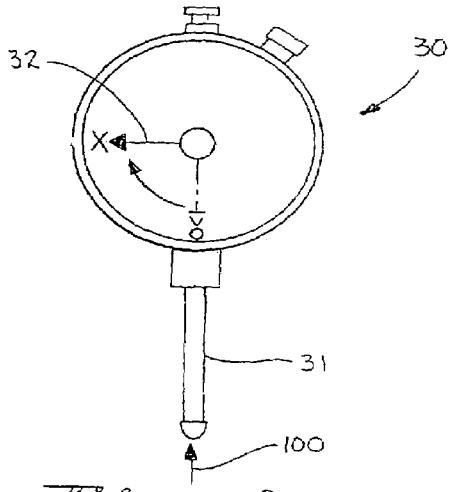
FIG. 9 is a front plan view of a drum gauge showing a reading of X force/pressure with certain force/pressure being applied to the gauge as represented by a vector.

It is noted that pressure-measuring or force-measuring gauges of the type generally depicted in the accompanying drawings provide the user with a visual indicator of how much force 100 is applied to the depression member 19. FIG. 8, for example, attempts to depict a pressure or force-measuring gauge 30 with zero force applied to the depression member 31 and the dial 32 outputting a visual reading of zero force accordingly. FIG. 9, by contrast, attempts to depict the same force-measuring gauge 30 with some force (as at vector arrow 100) applied to the depression member 31, which force 100 is visually indicated by movement of the dial 32 from a reading of zero force to a reading of some force as at "X". The drumhead 12 imparts varying forces upon the depression member 31 when in varying states of tension, which tension is generally directed orthogonally to the gauge-deflecting force 100 and is changeable via manipulation of the tension rods or rods 17.

It is contemplated that the torque-supplying means may be preferably defined by a so-called drum key or torque supplying implement 40 as generally illustrated and depicted in FIGS. 1-5. In other words, when opposing implements 40 are turned, the tension rods or screws 17 diametrically displace the counter hoop 15, which action functions to tension the drumhead 12 at the opposed drumhead portions 13. This action forces (as at 100) the opposed drumhead portions 13 into the gauge 30 as earlier described.

Thus, the torque-supplying means are cooperable with linearly opposed rods 17 for enabling the user to selectively tension opposed drumhead portions 13 substantially simultaneously, and the pressure-measuring means enable the user to monitor drumhead tension at the opposed drumhead portions 13 substantially simultaneously. Since opposing drumhead portions 13 are simultaneously (or nearly simultaneously) tensionable, the time it takes to finally tune a drum with a single drum gauge as put through the tuning sequences generally depicted in FIGS. 6-6(*b*) is otherwise cut significantly by apparatus 10. It is thus contemplated that the drumhead tuning system according to the present invention may well function to expedite drumhead tuning.

Notably, the order in which drum head tensioning rods, screws, or lugs are tightened is important. The preferred sequences shown in FIGS. 6-6(*b*) reflect attempts to equalize the tension across the drumhead at all times, which process is roughly akin to tightening the lug nuts when changing a tire on one's automobile. Further, tightening the rods, screws or lugs should be done in small increments back and forth across the drum in the sequence(s) depicted. Depending on the number of lugs on the drum, one may have up to 6 pairs of tensioning rods or screws 17 with which to deal. From a tuning perspective, the more tuning lugs or tensioning rods there are, the more accurately the drum can be tuned. Apparatus 10 essentially enables the user to work with opposed pairs of tensioning rods or screws 17 simultaneously for expediting and enhancing the tuning process.

Figure 2:
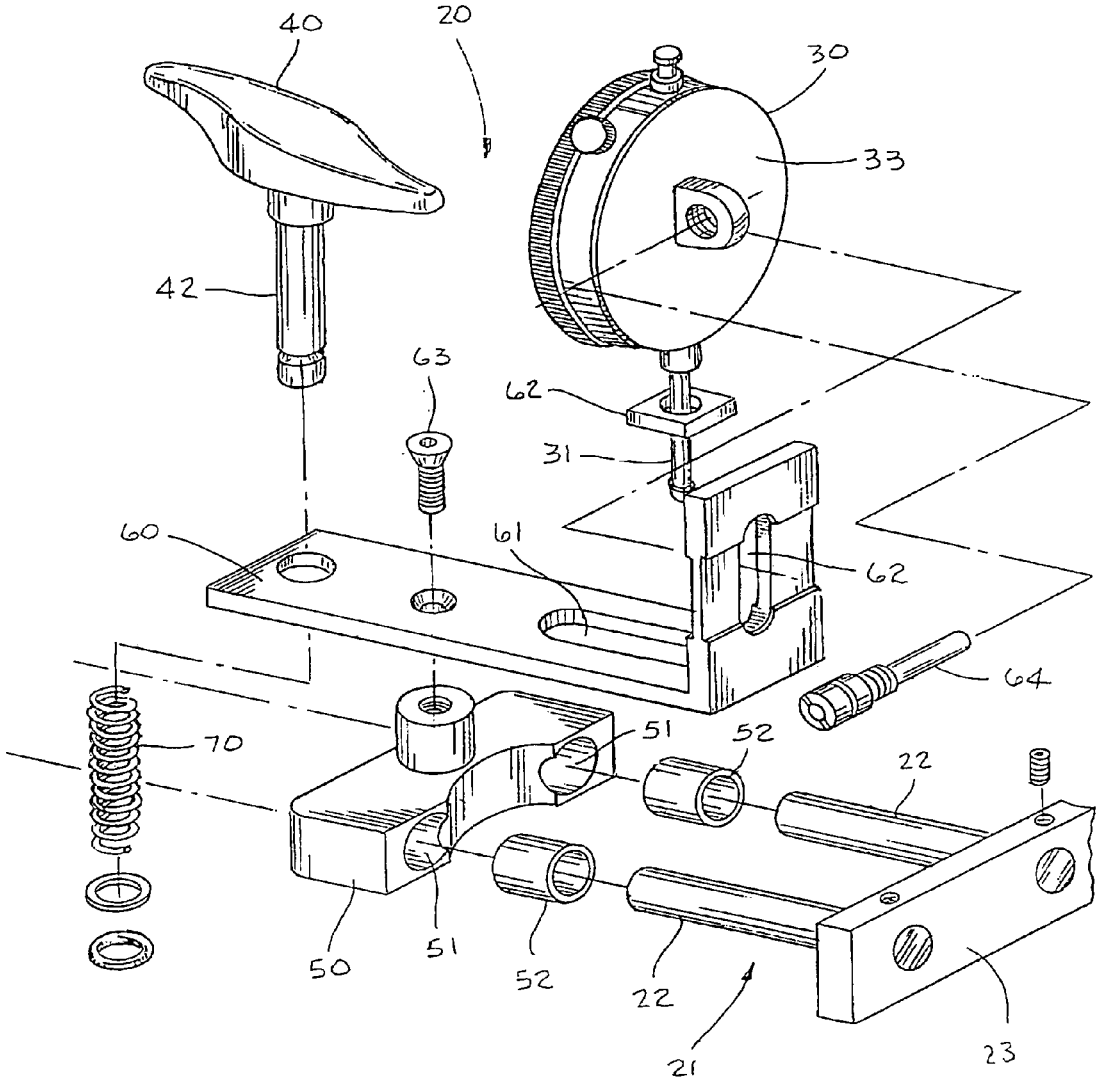
FIG. 2 is an exploded perspective view of a carriage-like tensioning/tuning assembly juxtaposed adjacent a fragmentary end portion of a track assembly.
Figure 3:
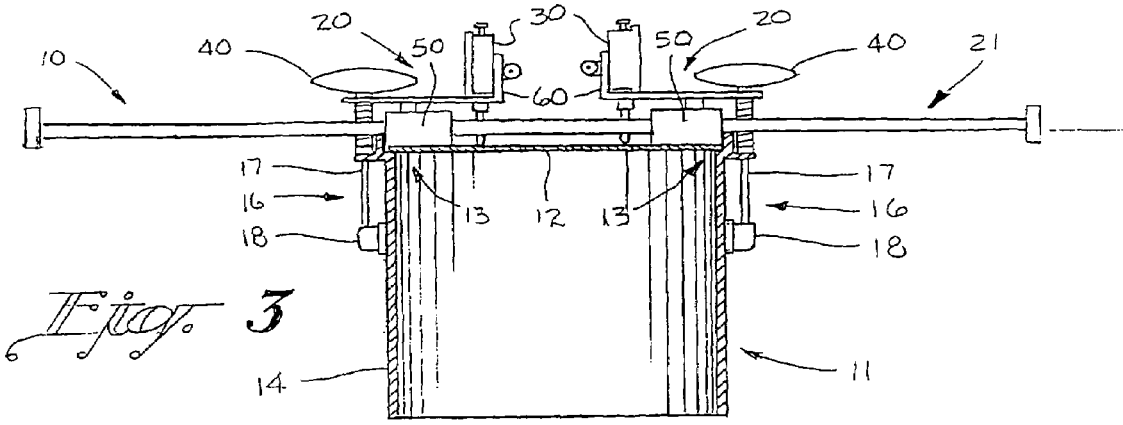
FIG. 3 is a first side plan view of the drumhead tensioning apparatus outfitted upon a first drum having a first diameter, which first drum is depicted in cross-section.
Figure 4:
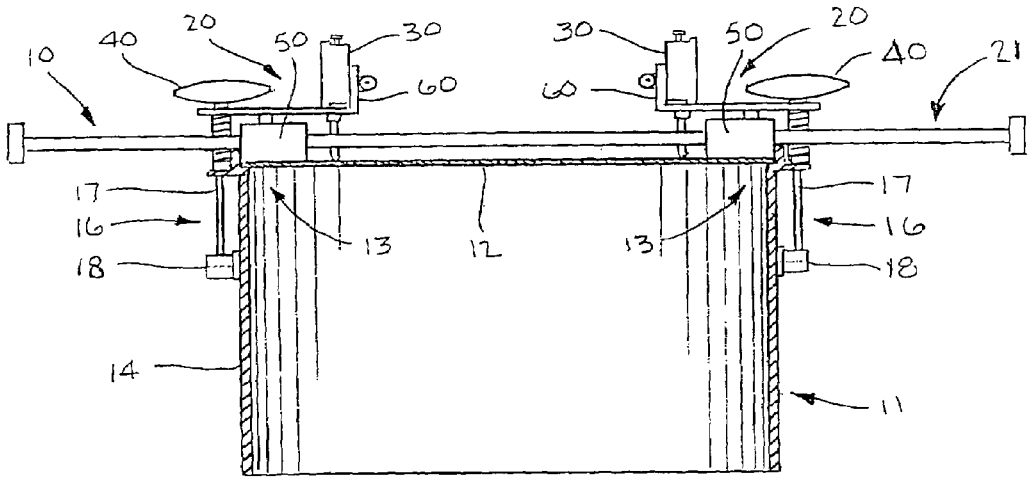
FIG. 4 is a first side plan view of the drumhead tensioning apparatus outfitted upon a second drum having a second diameter, which second drum is depicted in cross-section.
Figure 5:
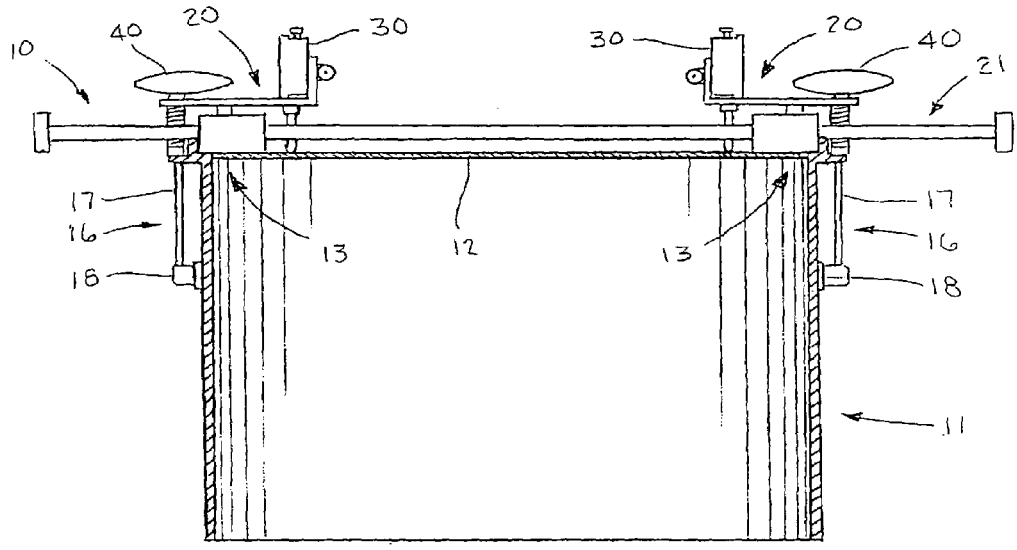
FIG. 5 is a first side plan view of the drumhead tensioning apparatus outfitted upon a third drum having a third diameter, which third drum is depicted in cross-section.
Figure 6A:
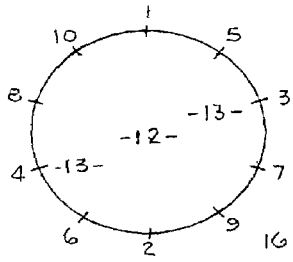
FIG. 6 is a top plan view of an eight (8) lug drum with preferred tuning sequence numbering set forth adjacent the circumference.
Figure 6B:
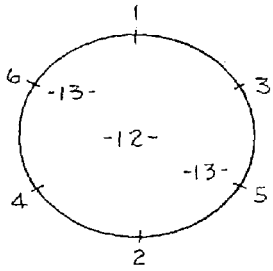
Figure 6:
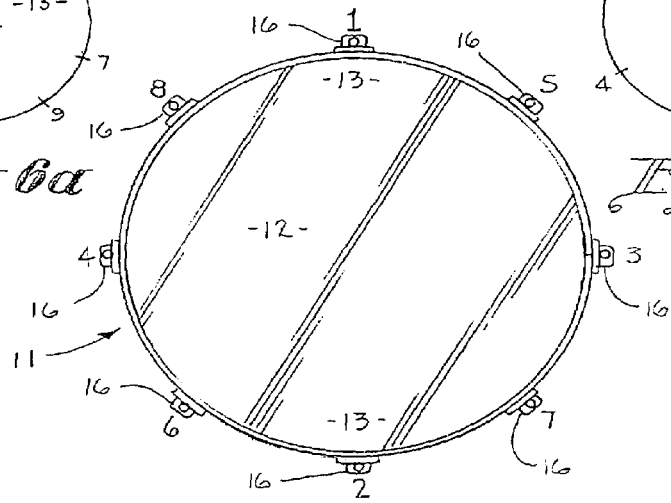
Figure 7:
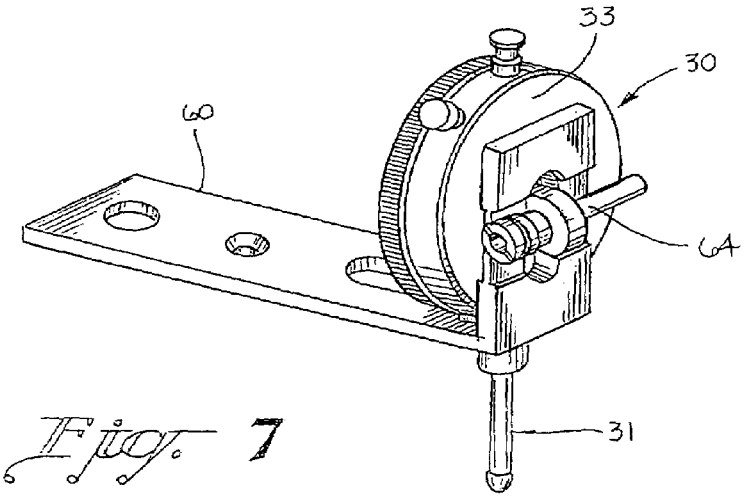
FIG. 7 is a posterior perspective view of a drum gauge fastened to an L-shaped bracket member of the tensioning/tuning assembly.

The gauges 30 and the implements 40 are attached (via various fastening means as generally depicted in FIG. 2) to certain track-engaging means via a bracket assembly 60. The depression members 31 of the gauges are received via first bracket apertures as at 61, and the dial housing 33 is spaced from the assembly 60 via a washer 62. The dial housing 33 comprises a flanged portion 34, which portion 34 may be fastener (64)-retained via second bracket apertures as at 62. The bracket assembly 60 may be screw-fastened to a rail-guide assembly 50 as depicted at 63. It is contemplated that the track-engaging means may well be defined by the rail-guide assembly 50, which assembly 50 rides upon linear and parallel track or rail members 22 for (1) spatially orienting the implements 40 above opposed tension rods or screws 17 and (2) spatially orienting the gauges 30 adjacent the opposed drumhead portions 13. The rail members 22 are spaced by rail-spacing blocks 23 as well as by the assemblies 50.

Notably, the rail members 22 intermediate first and second track ends should be of sufficient magnitude to accommodate drum heads of varying diameters/dimensions. Variously sized/dimensioned drum heads 12 may thus be accommodated by linearly displacing the carriage-like assemblies 20 along the rail members 22 or track 21 as comparatively depicted in FIGS. 3-5. From a comparative inspection of FIGS. 3-5, it may be seen that the displacement or distance between carriage-like assemblies 20 becomes respectively and progressively larger.

The rail-guide assemblies 50 may essentially be formed from a block outfitted with parallel apertures or bores 51, which bores 51 are sized and shaped to slidably receive the rail members 22 and prevent significant transverse displacements of the tensioning assemblies 20. The bores 50 may be preferably outfitted with friction-reducing sleeves 52 or bearings (not specifically illustrated) as a means to reduce friction and thermal energy transfer within the apparatus. Since tolerances are critical to drumhead tuning, it is contemplated that the minimization of thermal effects by reducing friction and the like will help maintain the materials used in the construction of the apparatus 10 at a static temperature during use so that the gauges 30 may more accurately display pressure or force readings as imparted thereupon from the tension at the opposing drumhead portions 13.

A further means to enhance the fine tuning ability of apparatus 10 is believed to stem from the incorporation of compression coil 70s into the tensioning assemblies 20, which compression coils 70 may receive the keyed end 42 of the implements 40 as generally depicted in various figures. It should be understood from an inspection of the noted figures that when the coil or spring is compressed, a restorative forces is directed against the displacement in the direction of the applied or supplied torque.

Notably, if the keyed ends 42 are coaxially received by the compression coils 70, the restorative forces are coaxial with the applied/supplied torque. It is contemplated that the coaxial restorative force enhances fine tuning ability of the apparatus 10 insofar as rotation of the tension rods or screws 17 may be made more controllable. In other words, it is contemplated that the coils or springs 70 may well provide certain rotation-controlling means for enhancing the fine tuning ability of the apparatus 10.

While the above descriptions contain much specificity, this specificity should not be construed as limitations on the scope of the invention, but rather as an exemplification of the invention. For example, the invention may be said to essentially teach or disclose a drumhead tuning apparatus 10 for expediting drumhead tuning, which tuning apparatus essentially comprises a track, certain tension-monitoring means (e.g. head gauges 30), and certain head-tensioning means (e.g. implements 40). The track as at 21 essentially comprises first and second track ends and essentially functions to track-guide the tension-monitoring and tension-adjusting means. The tension-monitoring means essentially function to enable simultaneous monitoring of drumhead tension adjacent the track ends and the tension-adjusting means essentially function to selectively adjust drumhead tension adjacent the track ends.

The tension-monitoring means may be defined by certain pressure-measuring means for measuring tympanic pressure. In this regard, it will be recalled that as the drumhead 12 is tensioned, it applies force/pressure against the gauge 30 for visually indicating to the user the state of tension in the drumhead 12 at that location. Conceivably, other means for monitoring the tension such as torque-indicating means could also be utilized. It is contemplated, however, that the gauges 30 here exemplified are preferred. In this last regard, it is noted that high quality drums are now being intentionally manufactured with lugs that cause resistance. The resistance induced by the lug itself can lead to faulty gauge readings that measure lug torque. For these and other reasons drum gauges that directly or indirectly measure drumhead tension are becoming popular, particularly since it is generally recognized in the art that drum gauges can cut several minutes to hours off of tuning time.

The tension-adjusting means may be defined by certain torque-supplying means for supplying torque to head-tensioning screws. Drumhead tension, however, may be achieved any number of ways. Head-tensioning screws or tensioning rods are common to the art, and thus the apparatus 10 according to the present invention preferably comprises torque-supplying means or a torque-enabling implement for enabling screw or rod adjustment.

The carriage assemblies or carriage-like tensioning assemblies 20 are cooperably and preferably linearly displaceable relative to one another via the track 21 for orienting and engaging the torque-supplying implements with head-tensioning screws of variously dimensioned drumheads 12. The track 21 is preferably linear for ensuring linear carriage assembly displacements. To reinforce the linear carriage assembly displacements, it is contemplated that the track 21 may preferably comprise parallel rail members.

In this regard, the carriage assemblies 20 may preferably comprise rail-guide assemblies cooperable with the rail members. The rail-guide assemblies may preferably comprise rail-receiving apertures, in which the rail members may be slidably received for enabling sliding rail-guide assembly action. Notably, the rail-receiving apertures are preferably being sized and shaped for preventing transverse carriage assembly displacements. The rail-receiving apertures may be outfitted with certain friction-reducing means for reducing friction intermediate the rail-guide assemblies and the rail members and for minimizing thermal effects on the track and carriage assemblies.

Further, it should be noted that perhaps the central benefit of the apparatus 10 is to expedite drumhead tuning by tensioning the drumhead 12 at opposed drumhead portions simultaneously. In this regard, the inventive concepts heretofore specified support certain drumhead tuning methodology, which methodology expedites (and enhances) drumhead tuning. The drumhead tuning method according to the present invention may be said to comprise the steps of: engaging first and second drum gauges with opposed drumhead portions; measuring drumhead tension at the opposed drumhead portions via the drum gauges; selectively applying torque to opposed head-tensioning screws radially adjacent the opposed drumhead portions; selectively tensioning opposed drumhead portions via the torque-applied head-tensioning screws; monitoring the drum gauges while selectively tensioning the opposed drumhead portions; and disengaging the drum gauges from the opposed drumhead portions when the monitored drum gauges display substantially the same reading.

It is contemplated that the drum gauges may be synchronized, reset, or zeroed before engaging the opposed drumhead portions. Further, the drum gauges may be linearly displaced relative to one another before engaging the opposed drumhead portions. In this regard, it will be recalled that the displaceable drum gauges may well function to accommodating drum or drumheads having various dimensions. Still further, it is contemplated that the drum gauges may be track-displaced or rail-guided relative to one another before engaging the opposed drumhead portions.

In this regard, it is noted that track-displaced or rail-guided drum gauges or pressure-monitoring means may ensure linear tensioning assembly displacements. Friction intermediate the parallel rails and the drum gauges may be preferably reduced or minimized for minimizing thermal effects on the rails and drum gauges and enhancing drumhead tuning.

Selectively applied torque at the tension rods or tension-adjusting means may be spring-resisted for enhancing drumhead tuning. Finally, the steps may be repeated with successive pairs of opposed drumhead portions until the monitored drum gauges display substantially the same reading thereby signifying a finally tuned drumhead.

Although the invention has been described by reference to a number of embodiments it is not intended that the novel apparatus or method be limited thereby, but that modifications thereof are intended to be included as falling within the broad scope and spirit of the foregoing disclosure and the appended drawings.

I claim:

1. A drumhead tuning system for expediting drumhead tuning, the tuning system comprising, in combination:

a drum assembly, the drum assembly comprising a drumhead, a shell, a counterhoop, and a plurality of tensioning rod assemblies, each tensioning rod assembly comprising a screw and a lug, the lugs being attached to the shell, the drumhead being stretched over the shell and there held by the counterhoop, the screws screw-connecting the lugs to the counterhoop for enabling drumhead tensioning by screw-displacing the counterhoop relative to the lugs;

opposed tensioning-tuning assemblies, each tensioning-tuning assembly comprising pressure-measuring means for measuring tympanic pressure and torque-supplying means for supplying screw-rotating torque, the torque-supplying means being cooperable with linearly opposed screws for enabling the user to selectively and simultaneously tension opposed drumhead portions, the pressure-measuring means for enabling the user to selectively and simultaneously monitor drumhead tension at the opposed drumhead portions, the tuning system thus for expediting drumhead tuning.

2. The drumhead tuning system of claim 1 comprising a track, the opposed tensioning-tuning assemblies being track-mounted and displaceable upon the track, the tensioning-tuning assemblies being cooperably displaceable relative to one another via the track for positioning the torque-supplying means with screws of variously dimensioned drum assemblies.

3. The drumhead tuning system of claim 2 wherein the track is substantially linear, the substantially linear track for ensuring linear tensioning-tuning assembly displacements.

4. The drumhead tuning system of claim 3 wherein the track comprises parallel rail members and the tensioning-tuning assemblies comprise rail-guide assemblies, the rail members and rail-guide assemblies for reinforcing linear tuning assembly displacements.

5. The drumhead tuning system of claim 4 wherein the rail-guide assemblies comprise rail-receiving apertures, the rail members being slidably received in the rail-receiving apertures for enabling sliding guide assembly action, the rail-receiving apertures being sized and shaped for preventing transverse tensioning-tuning assembly displacements.

6. The drumhead tuning system of claim 5 wherein the rail-receiving apertures are outfitted with friction-reducing sleeves, the sleeves for reducing friction intermediate the rail-guide assemblies and the rail members and for minimizing thermal effects on the system.

7. The drumhead tuning apparatus of claim 1 wherein the torque-supplying means comprise spring resistance, the spring resistance for imparting restorative forces coaxial with supplied torque.

8. A drumhead tuning apparatus for expediting drumhead tuning, the tuning apparatus comprising:

a track, the track comprising first and second track ends;

tension adjusting means for simultaneously adjusting drumhead tension adjacent the track ends; and combination tension monitoring and pressure measuring means for simultaneously monitoring drumhead tension and measuring tympanic pressure adjacent the track ends, the track for track-guiding said tension monitoring and adjusting means intermediate the track ends for adjusting and monitoring tension at diametrically opposed drumhead portions.

9. The drumhead tuning apparatus of claim 8 wherein the tension adjusting means are defined by torque supplying means for supplying torque to head tensioning rods.

10. The drumhead tuning apparatus of claim 8 wherein the track comprises parallel rail members and the tension monitoring and adjusting means are borne by rail-guide assemblies, the rail members for reinforcing track-guidance intermediate the track ends.

11. The drumhead tuning apparatus of claim 10 wherein the rail-guide assemblies comprise rail-receiving apertures, the rail members being received in the rail-receiving apertures for enabling sliding guide assembly action, the rail-receiving apertures being sized and shaped for preventing transverse guide assembly displacements.

12. The drumhead tuning apparatus of claim 11 wherein the rail-receiving apertures are outfitted with friction-reducing sleeves, the sleeves for minimizing friction and thermal effects on the apparatus.

13. The drumhead tuning apparatus of claim 9 wherein the torque-supplying means comprise spring resistance, the spring resistance for imparting restorative forces coaxial with supplied torque.

14. A drumhead tuning method for expediting drumhead tuning, the method comprising the steps of:

rail track-guiding tension monitoring means upon parallel rails to opposed drumhead portions;

engaging the tension monitoring means with the opposed drumhead portions;

monitoring drumhead tension at the opposed drumhead portions;

selectively tensioning the opposed drumhead portions; and disengaging the tension monitoring means from the opposed drumhead portions when the monitored drumhead tension at the opposed drumhead portions is equivalent.

15. The drumhead tuning method of claim 14 comprising the step of synchronizing the tension monitoring means before engaging the opposed drumhead portions.

16. The drumhead tuning method of claim 14 wherein friction and thermal effects are minimized while track-guiding the tension monitoring means to the opposed drumhead portions.

17. The drumhead tuning method of claim 14 wherein the steps are repeated with successive pairs of opposed drumhead portions until the monitored drumhead tension at all opposed drumhead portions is equivalent.

18. The drumhead tuning method of claim 14 wherein the step of selectively tensioning the opposed drumhead portions is defined by rotating tensioning rods via applied torque.

19. The drumhead tuning method of claim 18 comprising the step of spring-resisting the applied torque.

20. The drumhead tuning method of claim 19 comprising the step of coaxially aligning spring resistance with applied torque.

* * * * *